US005885024A

United States Patent [19]

Zupan et al.

[11] Patent Number: 5,885,024

[45] Date of Patent: Mar. 23, 1999

[54] ROOF TILE TIE DOWN CLIP

[76] Inventors: Frank J. Zupan, 175 Summit Dr.; Terrance D. Zupan, 2276 N. San Gorgonio, both of Banning, Calif. 92220

[21] Appl. No.: 784,060

[22] Filed: Jan. 17, 1997

[51] Int. Cl.[6] ..... B25G 3/36

[52] U.S. Cl. ..... 403/389; 403/405.1; 403/406.1; 52/543; 52/547; 52/549; 52/712; 248/300

[58] Field of Search ..... 52/712, 546, 547, 52/548, 549, 543; 403/384, 389, 405.1, 406.1, 407.1, 206; 248/300

[56] References Cited

U.S. PATENT DOCUMENTS

| | | | |
|---|---|---|---|
| D. 318,608 | 7/1991 | Schenker . | |
| 217,027 | 4/1879 | Currier . | |
| 378,725 | 2/1888 | Sagendorph . | |
| 468,015 | 2/1892 | Heberling . | |
| 673,229 | 4/1901 | Windle . | |
| 773,207 | 10/1904 | Kaiser | 248/300 X |
| 892,248 | 6/1908 | Garvin . | |
| 978,334 | 12/1910 | Overbury | 52/547 X |
| 1,232,196 | 7/1917 | Brague . | |
| 1,399,315 | 12/1921 | Ocampo | 52/548 |
| 1,479,067 | 5/1924 | Griswold | 52/548 X |
| 1,775,937 | 9/1930 | Keller . | |
| 2,060,739 | 11/1936 | Maddux . | |
| 2,710,159 | 6/1955 | Gordon | 248/300 X |
| 3,150,851 | 9/1964 | Ritchie et al. | 248/300 X |
| 3,210,896 | 10/1965 | Detman | 52/549 X |
| 3,401,497 | 9/1968 | Gregory, Jr. et al. . | |
| 3,531,073 | 9/1970 | Cortina | 248/300 X |
| 3,738,076 | 6/1973 | Kessler | 52/546 X |
| 3,998,019 | 12/1976 | Reinwall, Jr. . | |
| 4,089,141 | 5/1978 | Heroux . | |
| 4,102,105 | 7/1978 | Taylor et al. . | |
| 4,106,253 | 8/1978 | Aarons | 52/547 |
| 4,435,937 | 3/1984 | Stone . | |
| 4,698,942 | 10/1987 | Swartz . | |
| 4,821,482 | 4/1989 | Miller . | |
| 4,918,893 | 4/1990 | Vandenbroucke et al. | 52/712 X |
| 5,077,952 | 1/1992 | Moore . | |
| 5,181,360 | 1/1993 | Shingler | 52/547 X |
| 5,257,483 | 11/1993 | Netek . | |
| 5,307,860 | 5/1994 | Wilkinson et al. | 248/300 X |
| 5,339,608 | 8/1994 | Hollis et al. | 52/547 X |
| 5,392,579 | 2/1995 | Champagne | 52/547 X |
| 5,522,187 | 6/1996 | Bogaerts | 52/712 X |
| 5,533,313 | 7/1996 | Pike et al. | 52/547 X |

FOREIGN PATENT DOCUMENTS

| | | | |
|---|---|---|---|
| 2348684 | 4/1974 | Germany | 52/712 |
| 2132073 | 7/1984 | United Kingdom | 52/172 |

*Primary Examiner*—Donald P. Walsh
*Assistant Examiner*—Emmanuel M. Marcelo
*Attorney, Agent, or Firm*—Knobbe, Martens, Olson & Bear, LLP.

[57] ABSTRACT

A roof tile tie down clip for securing a roof tile to the surface of a roof. The roof tile tie down clip includes a base portion configured to rest against the surface of a roof, body portion extending away from the base portion such that a joint is formed between the base portion and the body portion, and a clip portion configured to engage the top surface of a roof tile and extending away from the body portion distal of the joint. Two claws extend outward from a tip of the base portion for securing the roof tile tie down clip to the surface of a roof in an upright position prior to inserting a nail through the clip. A gusset is formed at the joint between the base portion and body portion of the roof tile tie down clip. The gusset functions to reinforce the joint against bending or warping.

7 Claims, 5 Drawing Sheets

ROOF TILE TIE DOWN CLIP

BACKGROUND OF THE INVENTION

1. Field of the Invention

The present invention relates to a roof tile clip, and in particular, relates to a roof tile tie down clip for securing a tile to a roof where the clip is easily mounted to the surface of the roof and is resistant to deformation from excessive winds.

2. Description of the Related Art

Roof tiles are commonly used to cover the roof of a structure. The tiles provide protection to the roof from storms and other harsh weather conditions and also provide an attractive appearance to the roof. For a typical installation of tiles on a roof, a plurality of tiles are distributed over the roof so that the roof is entirely covered by the tiles. The tiles are positioned in overlapping fashion on the roof so that a first portion of one tile fits over a second portion of an adjacent tile, with a decorative portion of the tile remaining open to view. The weight of a tile thereby partially secures an adjacent tile to the surface of the roof. In this fashion, a multitude of tiles may be arranged over the entire roof.

During installation of roof tiles, tile clips are often used to secure the tiles in place on top of the roof so that the tiles do not fall off. The clips are designed to secure the exposed end of the tile from being lifted off of the roof during high winds. Tile roofs are increasingly used in such places as the Gulf Coast, Florida and other locations throughout the United States where there are occasionally weather conditions that result in high winds. Consequently, in these locations, the tile roofs are often exposed to winds that exceed 100 miles per hour. Without the tile clips, the wind can rip the exposed end of the tile in a row of tiles free from the roof. As the tiles overlap, this can result in a chain reaction wherein all of the tiles in the row are torn from the roof. These tiles can become dangerous projectiles in windstorms and can also leave the roof exposed to water damage resulting from the weather.

A typical roof tile clip includes a flat base portion that is secured to the surface of the roof with nails or screws. A body portion of the clip extends upward at an angle from the base portion and forms into hook or clip that engages the upper surface of a tile, thereby securing the tile in place. The clip portion typically conforms to the shape of the tile so that the clip portion may be placed in alignment over the tile to secure the tile in place. An exemplary tile clip is shown in U.S. Pat. No. 5,077,952.

Unfortunately, prior tile clips suffer from some disadvantages. One disadvantage relates to the manner in which a roof tile clip is installed over a roof tile. In order to install the roof tile clip, the clip must first be positioned in the correct orientation with respect to a roof tile. Specifically, the tile clip is balanced on its base so that it stands in an upright position with the hook portion of the clip engaging the upper surface of the tile. With the clip balanced in an upright position, the installer's hands are free to use a hammer to install a nail through the base portion and into the roof surface and thereby secure the clip and tile to the roof. However, the tile clip often topples over before an installer can insert the nail through the clip. The installer must then re-orient the tile clip in the correct upright position and attempt to hammer the nail again which results in inefficiencies in mounting the tiles.

Further, it is desirable for the clip portion of the tile clip to flushly mate with the upper surface of the roof tile so that the tile clip provides a secure hold on the tile. However, with previous tile clips there is a high likelihood that the tile clip will slide on the roof while the installer is driving the nail to secure the hook in the desired position. Hence, the tile clip may end up being positioned such that the clip portion of the clip is not correctly aligned over the tile so that the clip does not have a secure hold on the tile. It will be appreciated that exact placement of the tile clip with respect to the tile may be the difference between keeping the roof tiles on the roof and having the tiles blown off the roof during high winds.

Another disadvantage associated with prior roof tile clips relates to the ability of such clips to retain their shape during high winds. Prior tile clips have a tendency to bend or warp when exposed to high-velocity winds. Particularly, the tile clips bend or snap apart at the bend where the base portion of the tile clip is connected to the body portion of the tile clip, causing the clip to lose its grip on the roof tile. This is highly undesirable, as the tile may eventually fall off the roof and become damaged or cause damage to objects below the roof. This problem is exacerbated during intense winds, where there is a higher risk that a tile may be blown off a roof and cause damage to other structures or cause injury to humans. Moreover, as roof tiles are generally expensive to replace, there is also a monetary loss associated with the loss of a roof tile. The monetary loss to a homeowner may be considerable if numerous tiles become lost due to tile clips snapping or deforming during high winds.

In view of the foregoing disadvantages associated with prior roof tile clips, there is a need for a roof tile clip that may be easily and securely mounted in an upright position prior to installation so that an installer will not have to use his hand to hold the tile clip in place while inserting a nail through the clip. Moreover, there is also a need for a roof tile clip that is sufficiently strong to resist warping or bending when the clip is exposed to extreme wind conditions

SUMMARY OF THE INVENTION

The aforementioned needs are satisfied by the present invention. In one aspect of the invention, a roof tile tie down clip is used to secure a roof tile to the surface of a roof. The roof tile clip includes an elongated main portion having a first end and a second end. A base portion extends outward at an angle from the first end of the main portion. The base portion is configured to rest against the surface of the roof. A clip portion of the tile clip extends outward from the second end of the main portion. The clip portion is configured to engage a roof tile and hold the tile in place.

A positioning device is preferably formed or is otherwise attached to the base section. The positioning device is configured so as to temporarily attach the clip to the roof in a desired orientation and thereby retain the device in the desired orientation while a nail or other permanent securing device is used to fully secure the device to the roof in the desired orientation. In one embodiment, two claws extend outward from the base portion and preferably function to secure the tile clip in an upright position and advantageously prevent the clip from toppling over or sliding before an installer can insert a nail or screw through the clip.

In another aspect of the invention, a roof tile tie down clip for securing a roof tile to the surface of a roof consists of an elongated planar body. A first portion of the planar body is configured to rest against the surface of the roof and a second portion of the planar body is configured to engage a roof tile so that it holds the roof tile in place. An attaching means is integrally connected to the first portion of the planar body for removably securing the first portion of the planar body to the surface of the roof, so that the roof tile tie down clip stands in an upright orientation. A third portion of the planar body connects the first portion to the third portion. A strengthening mechanism is preferably provided at the joint between the first portion and the third portion wherein the strengthening mechanism interconnects adjacent surfaces of the first and third portions of the device so that the tendency of the joint to bend in response to winds is reduced. In the preferred embodiment, a gusset is located at a joint between the first portion and the third portion, which strengthens the rigidity of the roof tile tie down clip and preferably prevents the clip from warping at the location of the joint.

The invention also encompasses a method of securing a roof tile to the surface of a roof. A roof tile is positioned on the surface of the roof and a roof tile tie down clip is provided. The roof tile tie down clip is of the type having a base portion with claws and a clip portion configured to engage a roof tile. The roof tile tie down clip is positioned so that the claws on the base portion contact the surface of the roof and the clip portion engages the roof tile. The installer then strikes the base portion of the clip so that the claws engage the surface of the roof and secure the roof tile tie down clip to the surface of the roof in an upright position. The installer then hammers a nail through the base portion of the roof tile tie down clip to fasten the roof tile tie down clip to the roof so that it secures the tile to the roof.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1A:
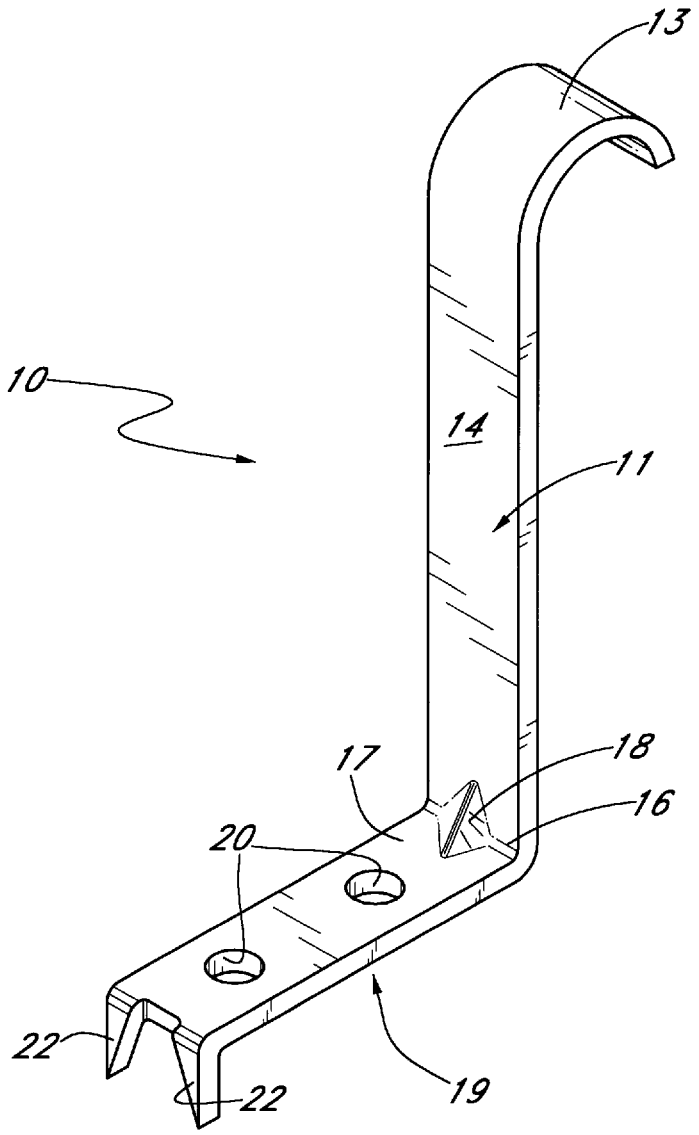
FIG. 1A is a perspective view of a preferred embodiment of the roof tile tie down clip of the present invention.

FIG. 1A illustrates a roof tile tie down clip 10 in accordance with a preferred embodiment of the present invention. The roof tile clip 10 includes a body portion 11, a base portion 12, and a clip portion 13.

Figure 3:
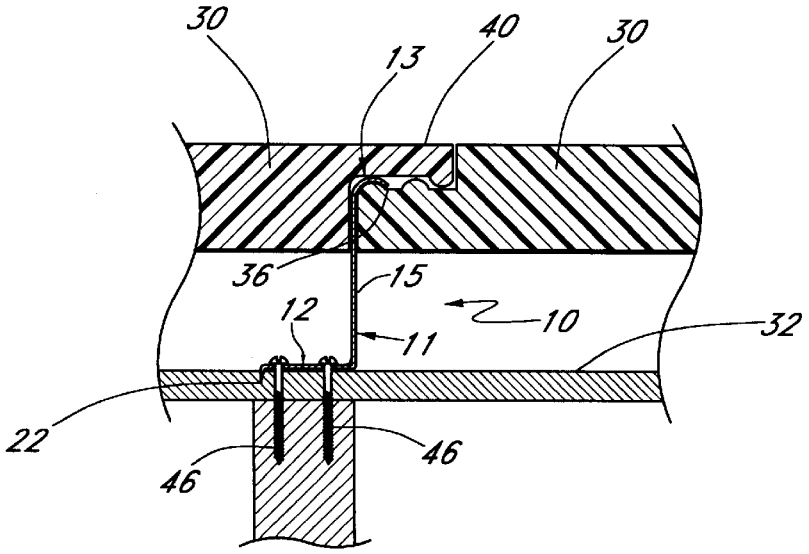
FIG. 3 is a cross-sectional side view of the roof tile tie down clip of FIG. 1 shown as it is used to secure a tile to the surface of a roof.

The body portion 11 of the roof tile clip 10 has an elongated, planar shape defining a first surface 14 and a second surface 15 (FIG. 3). The base portion 12 extends perpendicularly outward from the lower end of the body portion 11. The base portion 12 is preferably flat and defines two surfaces 17 and 19 and is configured to rest against the surface of a roof of a structure, as described in detail below. The body portion 11 and the base portion 12 are integrally joined together at a joint 16 so as to form a bend along the length of the roof tile clip 10. Although the illustrated embodiment shows the base portion 12 extending outward at a perpendicular angle from the body portion 11, it will become apparent from the following description that the angular relationship between the base portion 12 and the body portion 11 does not necessarily have to be perpendicular, but could assume a wide variety of angles.

A joint strengthening device 18 is formed in the joint 16 so as to interconnect the surface 17 of the base portion 12 and the surface 14 of the body portion 11 of the tile clip 10. By interconnecting the surfaces 14 and 17, the shape of the perpendicular angle at the joint 16 is less likely to be altered as the strengthening device 18 would have to be deformed prior to the angle of the joint 16 changing. In the preferred embodiment, the strengthening device is in the form of a gusset 18 that is located at the joint 16 inside the bend between the body portion 11 and the base portion 12. The gusset preferably reinforces the joint 16 against bending or warping, as discussed below. It will be appreciated that a gusset may be used at any of the bends along the length of the tile clip 10, such as in the clip portion 13. A gusset 26 is shown in the clip portion 13 in phantom in FIG. 1B.

Two holes 20 extend through the base portion 12. The holes 20 are preferably circular and have diameters that are sized to receive screws or nails for securing the clip 10 to the surface of a roof. A temporary securing mechanism comprised of two wedge-shaped claws 22 extends outward from the surface 19 at the end of the base portion 12 distal of the joint 16. The claws 22 preferably have pointed ends that are sufficiently strong to be hammered into the surface of a roof. It will become apparent from the following description that the claws 22 do not have to be positioned at the extreme distal end of the base portion 12, but could be positioned at a variety of locations along the base portion 12. Moreover, it will be appreciated that a single claw or other protrusion or adhesive configured to secure the base portion 12 of the clip 10 to the roof may be utilized without departing from the scope of the invention. However, the configuration of the claws 22 in FIG. 2 represent a preferred embodiment in accordance with the function of the claws, as described below.

The clip portion 13 of the roof tile tie down clip 10 is preferably integrally formed at the end of the body portion 11 distal of the joint 16. The clip portion 13 in this embodiment defines an arcuate shape that extends outward from the body portion 11 in a direction opposite the direction of the base portion 12. Specifically, the clip portion 13 forms an arc having a mouth that opens downwards towards the base portion 12. The clip portion 13 is configured to engage the upper surface of a roof tile. It will be appreciated that the clip portion 13 is preferably configured to flushly mate with an upper surface of a roof tile, as described in detail below. Hence, the shape of the clip portion 13 may be modified to mate with roof tiles of various shapes and is not limited to the arcuate shape as shown in FIG. 1A.

Figure 1B:
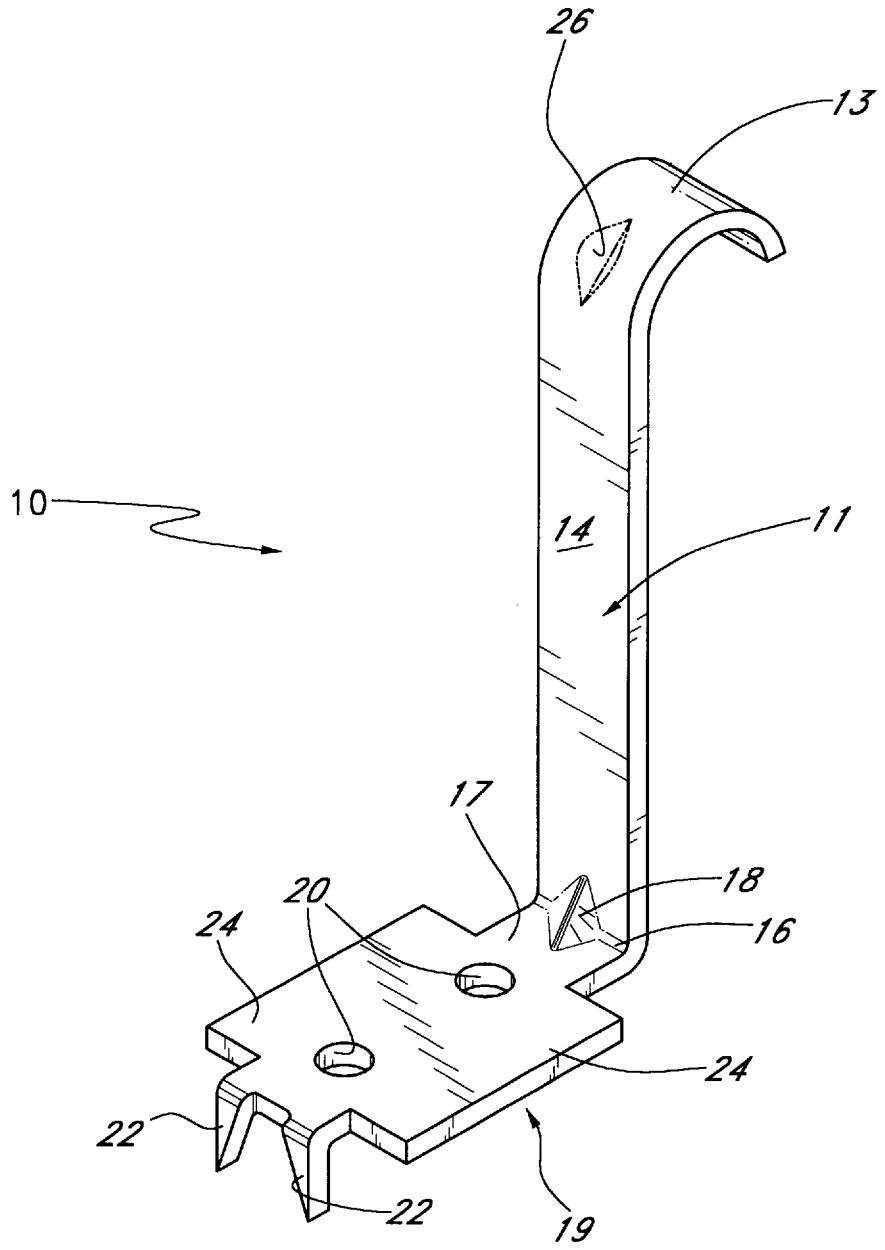
FIG. 1B is a perspective view of an alternative embodiment of the roof tile tie down clip illustrated in FIG. 1A.

Referring to FIG. 1B, an alternative embodiment of the roof tile tie down clip 10 is illustrated. Two tabs 24 extend outward from the base portion 12 in a plane defined by the base portion 12. Preferably, the tabs provide stability to the clip 10 when the clip is being balanced on the base portion 12 and also assist in correctly aligning the clip 10 upright when nails are inserted through the apertures 20.

Figure 2:
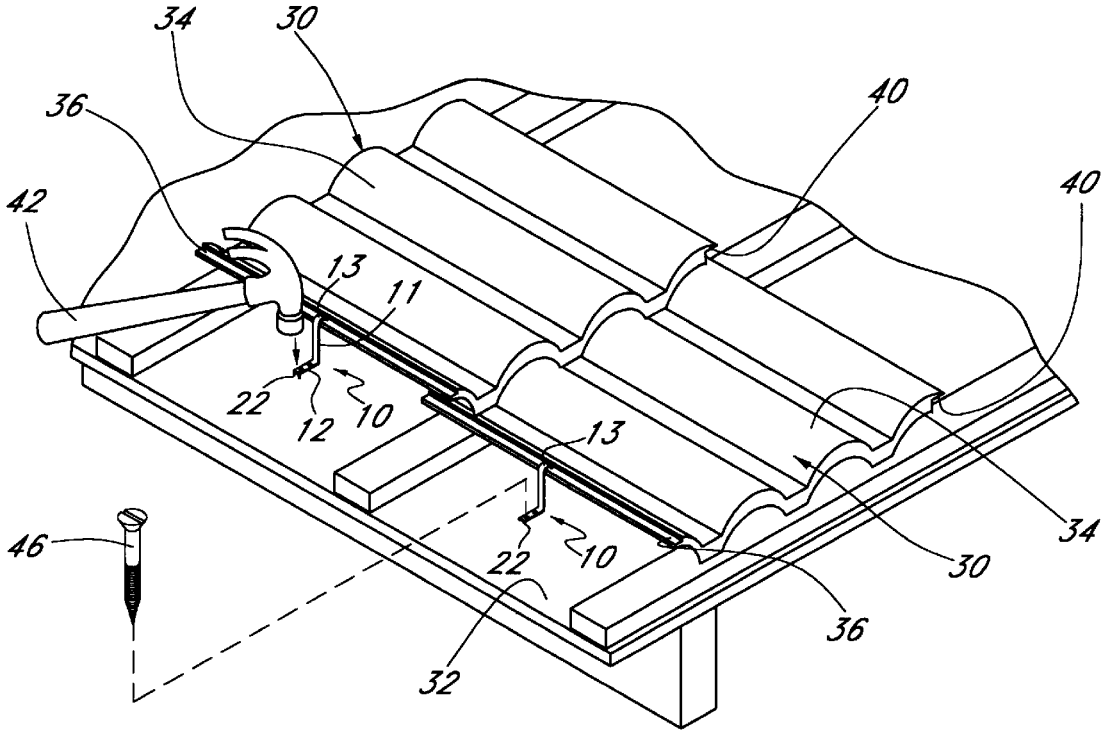
FIG. 2 is a perspective view of the roof tile tie down clip of FIG. 1 shown as it is used to secure a tile to the surface of a roof.

Referring to FIGS. 2 and 3, the roof tile tie down clip 10 is used to secure a roof tile 30 to the surface of a roof 32. In a typical tiled roof, a series of roof tiles 30 are positioned in overlapping fashion over the surface of the roof. An exemplary roof tile consists of a decorative portion 34 that is configured to be viewable when the roof tiles are arranged over a roof. Each roof tile 30 also has an upper overlapping portion 36 that is configured to mate with a corresponding lower overlapping portion 40 on an adjacent tile in the same row. As best shown in FIG. 3, the roof tiles 30 are arranged so that the lower overlapping portion 40 on one tile 30 rests on top of the upper overlapping portion 36 on an adjacent tile so that a row of tiles may be formed. In this manner, a series of rows of overlapping tiles 30 may be arranged over the surface of a roof 32 to cover the entire roof surface so that the decorative portions 34 of the tiles 30 are viewable. It will be appreciated that roof tiles may take a variety of different shapes and that the roof tile clip of the present invention is not limited to being used in conjunction with the roof tiles that are illustrated in FIG. 2.

Referring to FIG. 2, the roof tile tie down clip 10 is installed by positioning the base portion 12 on the surface of the roof 32 with the body portion 11 extending upward from the surface of roof 32 and the tips of the claws 22 pointing toward the roof 32. The hook portion 13 of the tie down clip 10 is positioned so that it rests on top of the upper overlapping portion 36 of the tile 30. As best shown in FIG. 3, the clip portion 13 preferably conforms to the shape of the tile 30 such that the clip portion may be flushly aligned over the tile 30 to thereby provide a maximum grip on the tile 30. If the clip portion 13 is not correctly positioned over the tile 30, the tie down clip 10 may not sufficiently secure the tile 30 in place. Hence, it is highly desirable for the clip portion 13 to be correctly aligned over the tile 30.

Once the clip 10 is correctly positioned over the tile 30, the installer then drives the claws 22 into the roof 32 to temporarily secure the clip 10 to the roof 32. A nail or screw may then be used to permanently secure the base portion 12 of the tie down clip 10 to the roof 32. Preferably, the body portion 11 of the tie down clip 10 has a length such that when the clip portion 13 is positioned over the tile 30 and the base portion 12 is secured to the surface of a roof with a nail or screw, the clip portion 13 exerts a downward force on the roof tile 30 sufficient to secure the roof tile 30 to the roof 32.

During installation of the roof tile tie down clip 10, an installer uses one hand to hold the tie down clip 10 in the correct orientation with respect to the roof 32 and the tile 30. Preferably, the installer may hold the roof tile clip 10 by the clip portion 13 so that there is a reduced likelihood of the installer striking his fingers with the hammer. The installer may then grab a hammer 42 with the other hand and strike the base portion 12 downward with the head of the hammer 42. The force of the hammer 42 on the base portion 12 preferably causes the claws 22 to wedge into the surface of the roof 32, as shown in FIG. 3. Preferably, the claws 22 engage the surface of the roof 32 so as to secure the tie down clip 10 in an upright position. The claws advantageously prevents the clip 10 from toppling over or slipping during permanent fixation of the clip 10 to the roof 32. The installer is then free to use one hand to position a nail or screw over each of the holes 20 in the base portion 12 and use the other hand to grasp a hammer or screwdriver for driving the nail or screw into the surface of the roof.

Hence, the claws 22 provide the advantage that the roof tie down clip 10 may be temporarily secured in the desired upright position prior to inserting a nail through the tie down clip. The claws 22 greatly facilitate the installation of the clip 10 on the roof 32 as the clip can be correctly positioned so as to secure the tile 30 to the roof while a nail or screw is being inserted through the base portion 13 of the clip. The claws 22 reduce the likelihood of the clip 10 sliding or moving during installation, which could otherwise result in the clip portion 13 not correctly mating with the tile 30 and reducing the hold of the clip 10 on the tile 30. Further, with the clip 10 securely positioned in place by the claws 22, the installer is less likely to knock the clip 10 over during installation. Moreover, the claws 22 aid in securing the clip 10 to the roof and further reduce the tendency of the clip 10 to become dislodged from the roof as both the claws 22 and the nails or screws are securing the clip to the roof.

Referring to FIG. 2, the gusset 18 functions to strengthen the roof tile clip 10 at the joint 16 between the base portion 12 and the body portion 11. The gusset 18 extends across the inside portion of the bend between the surface 17 of the base portion 12 and the surface 14 of the body portion 11 to thereby reduce the tendency of the joint 16 to further bend or to collapse. Specifically, the plastic deformation in the material of the tie down clip 10 caused by the shape of the gusset 18 serves to harden the material against further deformation. Hence, the gusset 18 increases the rigidity of the clip 10 and retains the joint 16 at the desired angle to advantageously reduce the likelihood of the tie down clip 10 bending or warping at the joint 16. This is advantageous because the roof tile tie down clip 10 may be used in areas of high winds that can act against exposed surfaces of the tile 32 with sufficient force to bend an otherwise unreinforced joint 16 so that the clip no longer secures the tile.

Figure 4A:
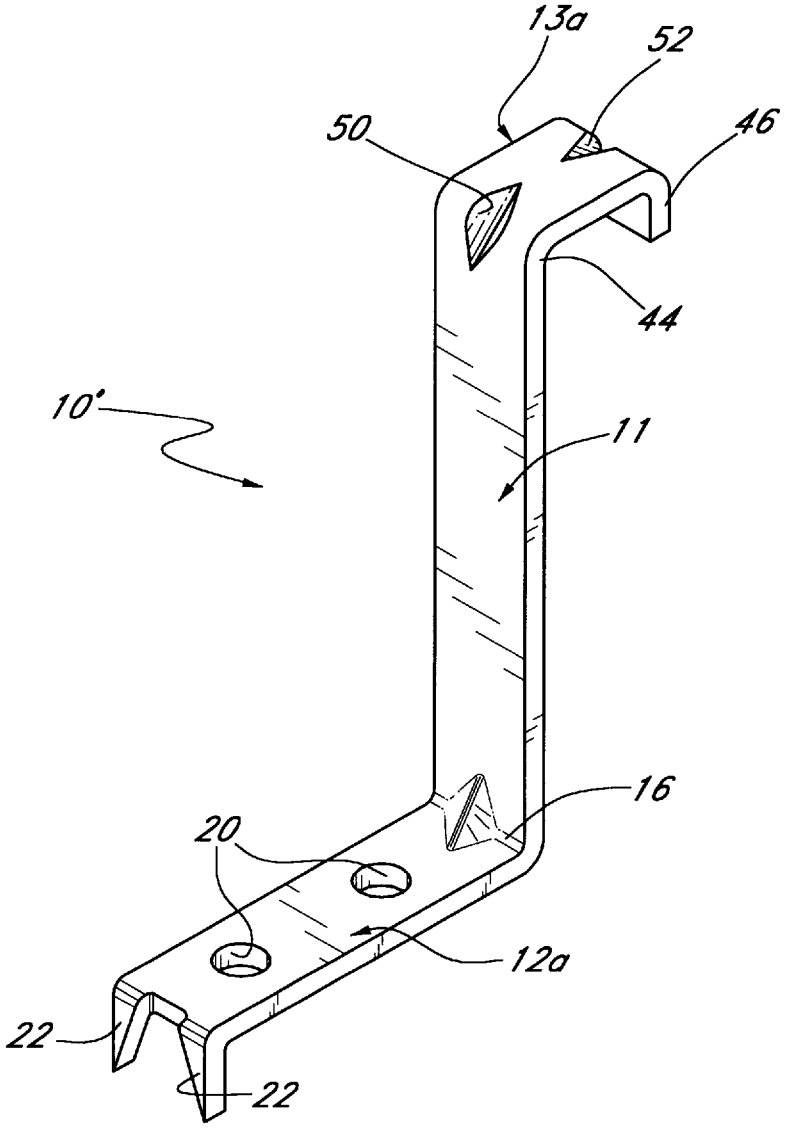
FIG. 4A is a perspective view of a second embodiment of the roof tile tie down clip of the present invention.

A second embodiment of the roof tie down clip 10' is shown in FIG. 4A. In this particular embodiment, an L-shaped clip portion 13*a* extends outward from the upper end of the body portion 11 in a direction away from the base portion 12. The clip portion 13*a* forms two bends 44 and 46 along the length of the tie down clip 10. As discussed, the shape of the clip portion 13 of the tie down clip 10 may be varied to conform to the shape of particular tiles so as to provide a secure grip on the tiles. The clip portion 13*a* shown in FIG. 4A may be used with tiles having straight surfaces that may flushly mate with the clip portion 13*a*. Securing mechanisms, namely gussets 50 and 52, are located at each of the joints 44 and 46. The gussets 50 and 52 preferably reinforce the bends 44 and 46, respectively, so as to maintain the desired angular orientations of the portions of the clip 10'. The clip portion 13*a* is configured to engage a roof tile 30 in the manner described above with regards to the previous embodiment.

Figure 4B:
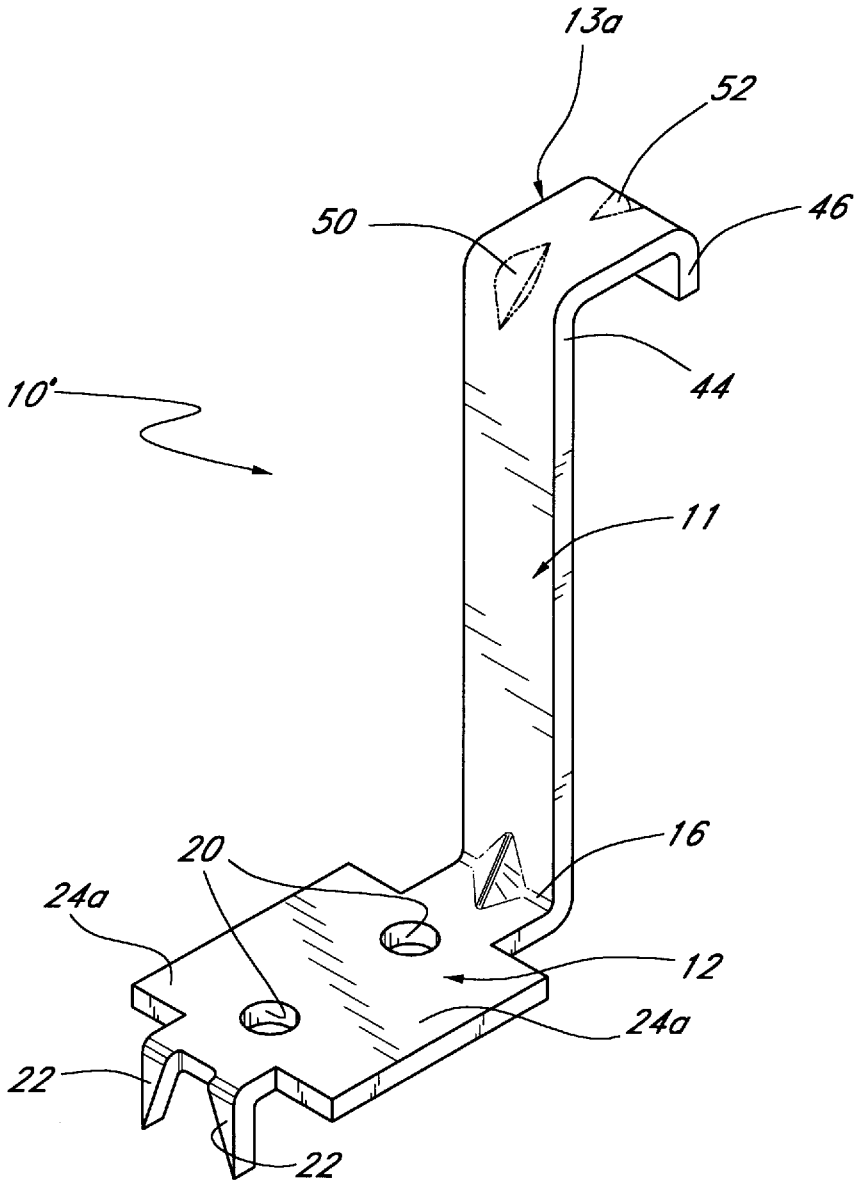
FIG. 4B is a perspective view of an alternative embodiment of the roof tile tie down clip illustrated in FIG. 4A.

Referring to FIG. 4B, the roof tile tie down clip 10' tabs 24*a* may be located on the base portion 12*a*, as discussed above with reference to FIG. 1B. It will be appreciated that the gussets 50 and 52 are optional and can be positioned for strengthening purposes on each of the joints of the clip. Hence, the gussets 50 and 52 are shown in phantom in FIG. 4B.

The roof tile tie down clip 10 may be made using a strip of material, preferably metal. Heat is applied to the strip of material to soften the material so that the joint 16 and the clip portion 13 may be formed to the desired angle and shape. The strengthening device 18, such as a gusset, may then be formed at the joint 16. Alternatively, separate strips of material may be attached together at desired angles to form the roof tile tie down clip 10. The roof tile tie down clip 10 may also be manufactured using an injection mold or by machining a piece of material into the shape of the tie down clip 10. Preferably the tie down clip 10 is made from a single piece of material.

As discussed, the roof tile tie down clip 10 of the present invention provides certain advantages. The claws 22 that are positioned along the base portion 12 may be used to secure the roof tile clip 10 in an upright orientation in the optimum location prior to inserting a nail or screw through the clip.

This advantageously saves the time that might otherwise be associated with the installer having to repeatedly reorient the clip in the correct position after the clip topples over. The claws also reduce the likelihood of an installer installing the device in an incorrect or less optimum location as a result of the clip moving during permanent fixation to the roof. Furthermore, the strengthening devices, such as gussets, provide reinforcement against warping to any bends along the length of the tie down clip as a result of high winds acting on the tile. Hence, the likelihood of the tie down clip bending or warping during high winds is greatly reduced which greatly enhances the securing capabilities of the clip.

Although the preferred embodiment of the present invention has shown, described, and pointed out the fundamental novel features of the invention as applied to these embodiments, it will be understood that various omissions, substitutions, and changes in the form of the detail of the device illustrated, may be made by those skilled in the art without departing from the spirit of the present invention. Consequently, the scope of the invention should not be limited to the foregoing discussion, but is to be defined by the claims which follow.

What is claimed is:

1. A roof tile tie down clip for securing a roof tile to a roof, comprising an elongated main portion having a first end and a second end, a base portion extending outward from the first end of the main portion and configured to rest on the roof, a clip portion extending outward from the second end of the main portion and configured to engage a roof tile, a securing device connected to the base portion and configured to temporarily secure the roof tile clip upright to the roof in a desired location prior to permanent fixation of said tile clip to said roof in said desired location, and a strengthening device located at a joint between the main portion and the base portion and configured to reinforce the shape of the joint and prevent deformation of the joint wherein the base portion is oriented relative to the main portion and the clip portion such that the roof tile clip may be balanced in an upright orientation wherein the base portion is positioned on the roof and the main portion extends upwardly form the roof and wherein at least one tab extends outward from the base portion in a plane defined by said base portion for stabilizing said tie down clip.

2. The roof tile clip of claim 1, wherein the temporary securing device comprises at least one claw that extends outward from said base portion so that when said at least one claw is driven into said roof, said roof tile clip is maintained in a desired orientation and position wherein said tile clip secures said roof tile to said roof.

3. The roof tile clip of claim 1, wherein said strengthening device comprises a gusset that interconnects a surface of the main portion to an adjacent surface of the base portion.

4. The roof tile tie down clip of claim 1, wherein the base portion extends outward at a 90 degree angle from the main portion.

5. The roof tile tie down clip of claim 1, wherein the clip portion is arc-shaped.

6. The roof tile tie down clip of claim 1, wherein the clip portion is L-shaped such that the clip portion defines two bends along the length of the roof tile tie down clip.

7. The roof tile tie down clip of claim 6, wherein a gusset is located at each of said two bends along the length of the roof tile tie down clip to prevent deformation of said bends.

* * * * *